United States Patent [19]

Hellstroem

[11] Patent Number: 4,617,971

[45] Date of Patent: Oct. 21, 1986

[54] LOOM CONTROL SYSTEM

[75] Inventor: Jerker Hellstroem, Nol, Sweden

[73] Assignees: Aktiebolaget IRO, Ulricehamn; Aros Electronics AB, Askim, both of Sweden

[21] Appl. No.: 588,866

[22] PCT Filed: May 11, 1983

[86] PCT No.: PCT/EP83/00121

§ 371 Date: Jan. 10, 1984

§ 102(e) Date: Jan. 10, 1984

[87] PCT Pub. No.: WO83/04056

PCT Pub. Date: Nov. 24, 1983

[30] Foreign Application Priority Data

May 12, 1982 [SE] Sweden ..... 8202991

[51] Int. Cl.[4] ..... D03D 51/34; D03D 47/36; B65H 51/20

[52] U.S. Cl. ..... 139/370.2; 139/452; 242/47.01

[58] Field of Search ..... 139/452, 370.2; 242/47.01, 47.12, 47.13

[56] References Cited

U.S. PATENT DOCUMENTS

| | | | |
|---|---|---|---|
| 3,776,480 | 12/1973 | Lawson | 242/47.01 |
| 3,853,153 | 12/1974 | Van Duynhoven | 139/452 |
| 4,165,049 | 8/1979 | Pejchal et al. | 139/452 |
| 4,215,728 | 8/1980 | Weidman et al. | 139/370.2 |
| 4,298,172 | 11/1981 | Hellstrom | 139/452 |
| 4,326,564 | 4/1982 | Teixeira | 139/370.2 |
| 4,407,336 | 10/1983 | Steiner | 139/452 |
| 4,541,462 | 9/1985 | Tholander | 139/452 |

FOREIGN PATENT DOCUMENTS

| | | |
|---|---|---|
| 1478294 | 4/1967 | France . |
| 1562223 | 4/1969 | France . |

*Primary Examiner*—Henry S. Jaudon
*Assistant Examiner*—Joseph S. Machuga
*Attorney, Agent, or Firm*—Flynn, Thiel, Boutell & Tanis

[57] ABSTRACT

The present invention relates to a loom control system operable to stop a loom in the presence of a yarn breakage. This loom comprises a feeding device having a yarn storage drum for temporarily storing the yarn and a yarn store sensor for sensing the quantity of yarn stored on the drum of the feeding device and for transmitting an electric sensor signal representing the quantity of yarn stored on the drum to the feeding device to control the operation of the feeding device and to thereby control the quantity of yarn stored on the drum. A monitor circuit is electrically connected to the yarn store sensor for receiving the sensor signal, wherein the monitor circuit derives information on yarn breakage before and/or after the feeding device from the sensor signal or its variation with respect to time to generate a stop signal for the loom.

6 Claims, 11 Drawing Figures

LOOM CONTROL SYSTEM

FIELD OF THE INVENTION

The present invention relates to a loom control system and, in particular, to a loom control system operable to stop a loom in the presence of a yarn breakage, the loom including a feeding device having a yarn storage drum for temporarily storing the yarn and including a yarn store sensor for sensing the quantity of yarn stored on the drum of the feeding device and for transmitting an electric sensor signal representing the quantity of yarn stored on the drum to the feeding device to control the operation of the feeding device in a manner controlling the quantity of yarn stored on the drum, the loom control system including a monitor arrangement for stopping the loom in response to a yarn breakage.

BACKGROUND OF THE INVENTION

A loom control system comprising these features is already known from U.S. Pat. No. 4,326,564. In the art of weaving it is well known to provide an automatic loom with a loom control system operable to stop the loom in the presence of a yarn breakage. Automatic looms comprise a feeding device having a yarn storage drum for temporarily storing the yarn. Such feeding devices eliminate the wide variations in yarn tension which occur when a yarn is delivered from a supply source, and permit the yarn to be fed to the loom at a substantially constant tension, although the yarn is intermittently fed from the feeding device to the loom. Typically, such feeding device may either have a yarn storage drum upon which the yarn is wound as the drum is driven by an electric motor or the feeding device may incorporate a stationary yarn storage drum with an orbiting feeder tube driven by an electric motor and engaging the weft yarn to apply it to the surface of the stationary yarn storage drum. The feeding device includes a yarn store sensor which senses the quantity of yarn stored on the drum of the feeding device. The yarn store sensor generates an electric sensor signal representing said quantity of yarn. This signal is used for controlling the operation of the feeding device so as to control the quantity of yarn stored on the drum. Particularly, the sensor signal might be fed to a control unit which controls the operation of the feeding device by increasing or decreasing the rotary speed of the motor of the feeding device in such a manner so that the quantity of yarn stored on the drum essentially remains between a maximum quantity and a minimum quantity of yarn.

It is also known from the above-mentioned U.S. patent to equip loom control systems of the above-mentioned kind with a monitor means for stopping the loom in the presence of a yarn breakage. Such monitor means is necessary, as the weft yarn being conveyed from the yarn supply spool to the feeding device might break, which results in the weft yarn stored on the yarn storage drum ultimately becoming exhausted if the loom continues to operate. In that event, the insertion of the broken yarn will produce a defect in the woven fabric. Thus, it is desirable to stop the operation of the loom in case of a yarn breakage. The prior art monitor means comprise a tension device arranged between the yarn supply spool and the feeding device for sensing the yarn tension. The tension device generates a signal having a high logical potential if the yarn tension is above a predetermined value. If there is no yarn breakage, the output signal of the tension device is "high" during the feeding operation of the feeding device. If contrary hereto there occurs a yarn breakage between the yarn supply spool and the yarn storage feeder, the output signal of the tension device changes to zero potential. Thus, the occurence of a zero-signal during the operation of the feeding device is indicative of a yarn breakage, so that the simultaneous occurence of this zero-tension signal and a signal indicating the feeding device operation can be used for stopping the loom.

However, a yarn breakage might also occur between the yarn storage feeder and the loom. The prior art loom control system can only recognise this second kind of yarn breakage if it is equipped with a second tension device between the feeding device and the loom. Therefore, the prior art loom control system is undesirably complicated if arranged such that it is responsive to a yarn breakage before and after the feeding device. Furthermore, the prior art loom control system is not adapted to stop the loom in case of a malfunction of the feeding device, said malfunction either resulting in the case where the quantity of yarn stored on the drum exceeds a maximum quantity or resulting in the contrary case where the quantity of yarn falls below a predetermined minimum quantity. It is considered as being a further drawback of this prior art loom control system that its tension devices only have a quite unreliable operation as they are highly sensitive to dirt and dust which can prevent a correct operation of the tension device. Particularly, the free movability of the mechanically movable parts of the tension device can be blocked by dirt or dust. In addition, considerable wear occurs between yarn guiding eyelets of the tension device and the yarn. The wear increases in the case of an accumulation of dirt at the eyelets.

The task underlying the invention is to provide a loom control system in accordance with the generic clause of the main claim, which has a simple and cost-saving structure and which is reliable in operation.

SUMMARY OF THE INVENTION

This technical problem is solved by a loom control system which is based on the principal idea that information on yarn breakage is directly derivable from a sensor signal representing the quantity of yarn stored on a yarn storage drum or from the sensor signal variation with respect to time. In other words, the yarn store sensor which is used in prior art loom control systems only for controlling the feeding operation of the feeding device is also used as a yarn breakage detector by being connected to a monitor means deriving information on yarn breakage before and/or after the feeding device from said sensor signal or its variation with respect to time. Thus, complicated, costly and unreliable additional yarn breakage sensors, like tension devices, as they are used in prior art loom control systems, are superfluous in the loom control system according to the present invention. Thus, the present invention provides a cost-saving, simple and reliable loom control system. An additional advantage of the present loom control system consists in that it is capable of detecting a malfunction of the feeding device or of a control unit for controlling the feeding operation of the feeding device, and that it is further capable of stopping the loom in case of a malfunction of the feeding device. An additional advantage of the loom control system in accordance with the present invention is that it avoids a problem of prior art loom control systems regarding the arrangement of a yarn breakage sensor in the narrow space between a yarn supply means and the feeding device.

When carrying out the invention according to one form of the invention, the most simple kind of yarn store sensors can be used, namely a so-called digital yarn store sensor generating a sensor signal indicating whether or not the quantity of stored yarn is below a minimum threshold. Under normal operation conditions, i.e. if there is no yarn breakage before the feeding device, the quantity of yarn stored on the drum only passes below a minimum threshold during a very short period of time, as in this case the feeding device is controlled to increase the quantity of yarn stored on the drum. If contrary hereto a yarn breakage occurs before the feeding device, the quantity of yarn stored on the drum runs and remains below the minimum quantity or below the minimum threshold as no yarn can be fed to the drum even by accelerating the feeding device operation. The monitor means comprises a time circuit responsive to a lapse of time during which the sensor signal indicates that the quantity of stored yarn is continuously below this minimum threshold. If this lapsed time exceeds a predetermined time threshold, which clearly indicates a yarn breakage before the feeding device, the monitor means stops the operation of the loom.

A loom control system according to a further form of the invention can be used for controlling the operation of a loom which is equipped with a feeding device of the kind which is controlled to essentially continuously feed the yarn to the drum. Under normal operating conditions, that means if no yarn breakage occurs before the feeding device, the quantity of yarn stored on the drum continuously increases due to the feeding device operation, if no yarn is withdrawn by the loom from the drum, and continuously decreases, if a withdrawal of yarn from the drum takes place. During the latter condition, this means during withdrawal of yarn from the drum the time-dependent quantity of stored yarn has a predetermined negative gradient, wherein this negative gradient corresponds to the quantity of yarn fed to the drum by means of the feeding device per time unit, diminished by the quantity of yarn withdrawn from the drum per time unit. If a yarn breakage occurs before the feeding device, said negative gradient becomes more negative than the above mentioned one due to the fact that the quantity of yarn fed to the drum by means of the feeding device becomes zero in case of a yarn breakage.

Thus, information on yarn breakage can be derived from the absolute value of said negative gradient of the quantity of stored yarn with respect to the time. The above-mentioned yarn breakage detection is carried out by a loom control system according to the invention and is considered as being highly advantageous as it stops the loom operation without any essential time delay between the occurence of a yarn breakage and the stopping of the loom. In other words, the loom control system is capable of detecting a yarn breakage without any time circuits and thus operates extremely fast.

A further form of the invention relates to a loom control system which is a modification of the system just discussed and which is also adapted for, but not limited to, controlling a loom which is equipped with a feeding device having a so-called on-and-off-operation. In other words, the loom control system can also be used for a loom, the feeding device of which is not controlled to essentially continuously feed the yarn to the drum. Under normal operation conditions of the loom, if no yarn breakage occurs before the feeding device, the quantity of stored yarn only decreases during a certain period of time until reaching a lower or minimum threshold, and then increases due to the feeding device operation. If there is a yarn breakage before the feeding device, the gradient of the sensor signal as generated by the yarn store sensor remains negative as no yarn is fed to the drum. Therefore, it is possible to derive information on yarn breakage in response to a lapse of time during which said gradient is continuously negative.

When carrying out the invention according to another form thereof, the loom control system is capable of detecting a yarn breakage between the feeding device and the loom. Under normal operational conditions (if there is no yarn breakage between the feeding device and the loom), a weft yarn insertion in the loom results in a decreasing quantity of yarn stored on the drum and therefore in a negative gradient of the quantity of stored yarn with respect to time. When the weft yarn insertion is completed or when no further weft yarn insertion takes place, the withdrawal of the yarn from the drum will also come to an end but with a certain time delay relative to the weft yarn insertion operation, wherein this time delay is caused by a slack in the yarn between the feeding device and the loom and by the elasticity of the yarn itself. Thus, the gradient of the quantity of yarn stored on the drum will become positive a certain period of time after completing the weft yarn insertion. If there is a yarn breakage, the gradient of the quantity of yarn stored on the drum will not change from a negative gradient to a zero gradient or a positive gradient. Thus, information on yarn breakage can be derived by detecting whether or not the gradient of the quantity of yarn changes from a negative gradient to a zero or positive gradient within a predetermined period of time after completing the weft yarn insertion. Thus, the monitor means stops the loom if the above mentioned condition is not fulfilled, which indicates that a yarn breakage between the feeding device and the loom has occurred.

A further advantageous embodiment of the present invention includes a loom control system which can be used for a loom equipped with a feeding device which is controlled to essentially continuously feed the yarn to the drum. The loom control system is adapted to stop the operation of the loom if a yarn breakage occurs between the feeding device and the loom. Under normal operational conditions, where no yarn breakage occurs between the feeding device and the loom, the quantity of yarn stored on the drum decreases during weft yarn insertion in the loom. In other words, the gradient of the quantity of stored yarn is negative during weft yarn insertion, although the feeding drum feeds yarn to the drum at all times. If the yarn breaks between the feeding device and the loom, no yarn is withdrawn from the drum during weft yarn insertion. Thus, the quantity of yarn stored on the drum increases even during the inserting of the loom. Consequently, a positive gradient of the quantity of stored yarn with respect to time during weft yarn insertion can be used for deriving information on yarn breakage between the feeding device and the loom. The loom control system operates without any essential time delay between the occurence of yarn breakage and the stopping of the loom, as this system does not require any time circuit for detecting the yarn breakage.

BRIEF DESCRIPTION OF THE DRAWINGS

Hereinafter, preferred embodiments of the present invention are described with reference to the accompanying drawings, wherein.

DETAILED DESCRIPTION

Figure 1:
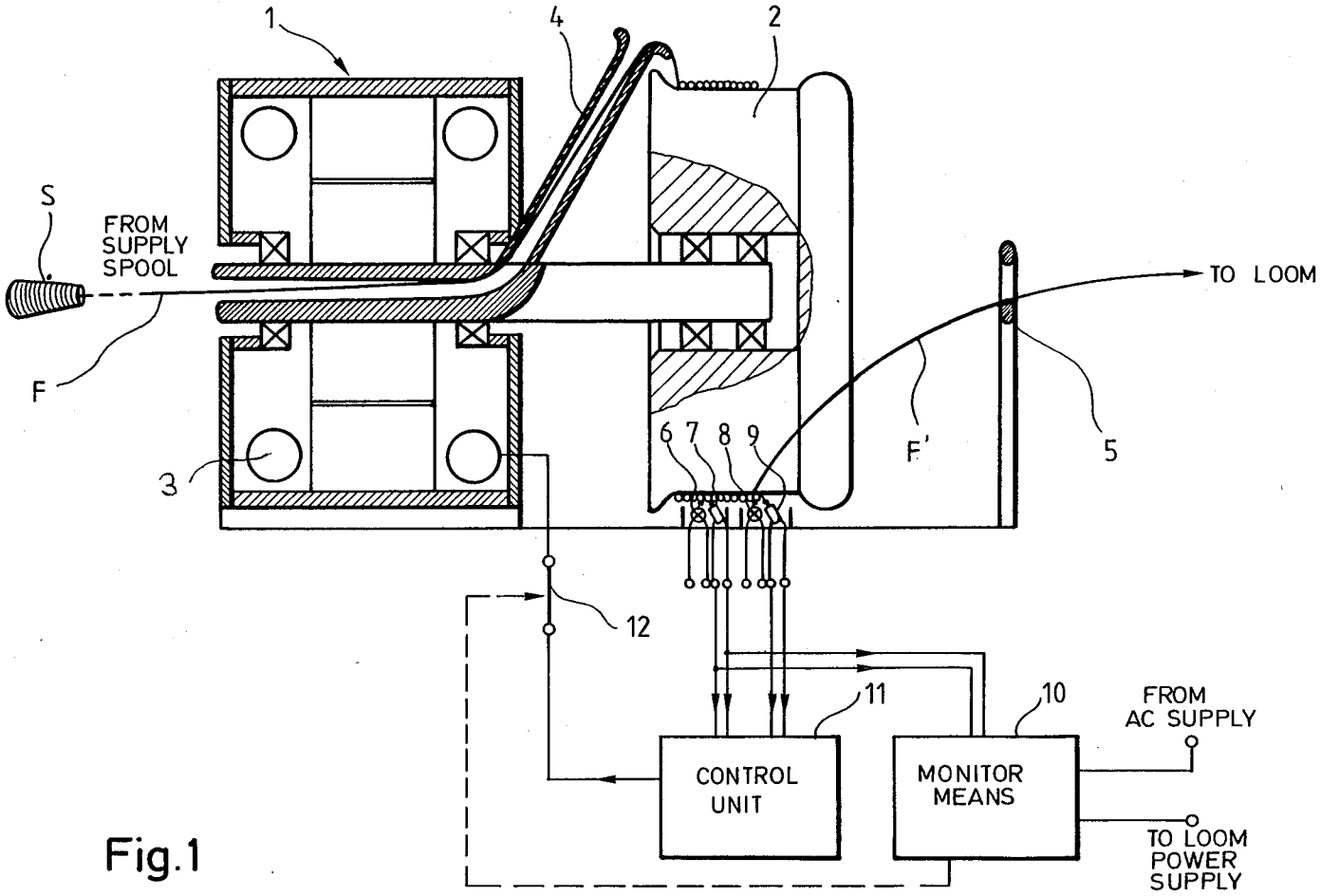
FIG. 1 shows a cross section through a feeding device having a yarn store sensor, and a loom control system connected thereto.

As shown in FIG. 1, a feeding device 1 of a loom or weaving machine comprises a yarn storage drum 2, an electric motor 3 and an orbiting feeder tube 4. The yarn storage drum 2 is rotatably connected to a shaft of the electric motor and is maintained in a stationary position with respect to its environment by a magnetic means (not shown here). The orbiting feeder tube 4 has an inner bore guiding the yarn F from a supply spool S to an outer circumferential surface of the yarn storage drum 2. The orbiting feeder tube 4 is driven by the electric motor 3. For purposes of the present disclosure, reference will be made to the so-called stationary drum feeding devices, wherein this art is exemplified by U.S. Pat. No. 3,776,480 and by U.S. Pat. No. 3,853,153. It should be noted that the present invention has equal application to so-called rotary drum feeding devices.

The yarn is withdrawn from the yarn storage drum 2 through a withdrawal eyelet 5 to the loom or to the weaving machine (not shown here). As shown in FIG. 1, and in more detail in FIG. 2, the feeding device is provided with a yarn store sensor 6–9. In the shown embodiment, the yarn store sensor consists of a so-called minimum sensor 6 and 7 and a so-called maximum sensor 8,9. Each of these sensors comprise a respective light emitting device 6,8 and a light sensing device 7,9. The detailed operation of these sensors will be explained with reference to FIGS. 3 and 4. The respective sensors are arranged so as to oppose predetermined axial locations at the surface of the yarn storage drum 2 corresponding to a predetermined maximum quantity of stored yarn or a predetermined minimum quantity of stored yarn, respectively. The output signals of the respective light sensing devices 7,9 of the minimum sensor or the maximum sensor are fed to a control unit 11 for controlling the operation of the electric motor 3 so as to thereby control the momentary quantity of yarn stored on the storage drum 2. Control units for properly controlling the speed of the motor 3 are well known in the art. This art is exemplified by the Swedish Pat. No. 77 12 808 (applicant's own).

A monitor means 10 is electrically connected to the yarn store sensor 6–9 for receiving the sensor output signal. The monitor means 10 is responsive to the sensor signal and, in particular derives information on yarn breakage before and/or after the feeding device 1 from said sensor signal or its variation with respect to time to generate a stop signal for the loom in case of a yarn breakage or to interrupt the power supply line of the loom. The generated stop signal for the loom can also be used for opening a feeder device stop switch 12 which electrically connects the electric motor 3 with the control unit 11. Thus, in case of a yarn breakage, the monitor means 10 stops the operation of the loom and the feeding device.

Figure 2:
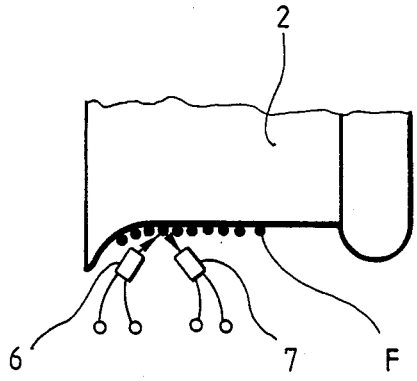
FIG. 2 shows an enlarged view of the yarn store sensor and its arrangment with respect to a storage drum of the feeding device of FIG. 1.
Figure 3:
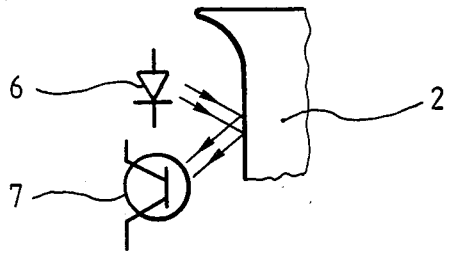
FIGS. 3 and 4 are an illustration for explaining the mode of operation of a digital yarn store sensor.
Figure 4:
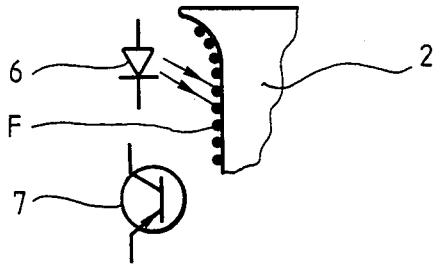

Referring now to FIGS. 2 to 4, the mode of operation of a so-called minimum sensor will be explained. The light emitting device 6, which might be a conventional light emitting diode supplied with a DC-voltage, generates a light beam, which is directed to a light-reflecting surface of the yarn storage drum 2. If there is no yarn at the location of the drum surface opposing said light emitting device 6, the incoming light will be reflected by the surface. Otherwise, no light reflection takes place, that means which the energy of incoming light is attenuated by the yarn. A light sensing device 7, which might be a light-sensitive transistor 7, is located near the light emitting device 6 so as to receive the reflected light energy. Thus, an optical minimum or maximum sensor, as known per se in the art, can be realized.

Figure 5:
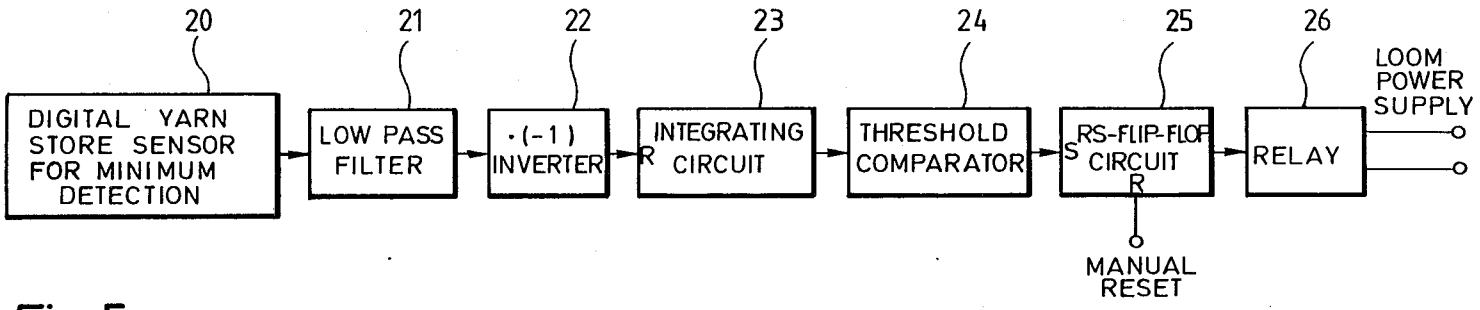
FIG. 5 is a system block diagram of a first embodiment of the present invention.

Referring now to FIG. 5, a first embodiment of the loom control system in accordance with the present invention comprises a digital yarn store sensor 20, a low pass filter 21, an inverter 22, an integrating circuit 23, a threshold comparator 24, a RS-flip-flop circuit 25, and a relay 26. The digital yarn store sensor 20 generates a sensor signal indicating whether or not the quantity of stored yarn is below a minimum threshold. This yarn store sensor can comprise a light emitting device 6 and a light sensing device 7, as shown in FIGS. 1 to 4. Said sensor signal has a high logical potential if the quantity of stored yarn is below a minimum threshold. Said sensor signal has a noise component, which is attenuated by the low pass filter 21 connected to the sensor 20. The inverter 22 is connected to the output of the low pass filter 21 for inverting the logical value of the output signal of the low pass filter. The inverter output signal has a low logical potential if the sensor signal indicates that the quantity of stored yarn is below a minimum threshold. The inverter output signal 22 is fed to a reset-terminal of an integrating circuit 23. The integrating circuit 23 generates a continuously increasing output signal when it is not reset by a high logical potential reset signal fed to its input. Otherwise, the integrating circuit 23 has a zero voltage output signal. The threshold comparator 24 compares the output signal of the integrating circuit 23 with a predetermined voltage threshold. If its input signal exceeds the voltage threshold, the comparator 24 transmitts a high logical potential. Otherwise, the threshold comparator 24 generates a zero voltage output signal. The output of the threshold comparator 24 is electrically connected to the set-terminal of the RS-flip-flop circuit 25. This circuit 25 is set by a high signal as received from the threshold comparator. It remains in its set-condition until it is reset by feeding a high potential signal to its reset terminal. A power-relay is connected to the output of circuit 25. The relay interrupts the loom power supply line, if a high logical potential is fed to its input terminal.

Hereinafter, the mode of operation of the embodiment as shown in FIG. 5 will be explained. Under normal operational conditions, where no yarn breakage occurs between the feeding device 1 and the supply spool S, the output signal of the digital yarn store sensor 20 generally remains at low logical potential. However, even under said conditions, the yarn store sensor 20 periodically generates pulses of high logical potential due to the fact that there is a time delay caused by the response-time of the electric motor 3 between the detection of a minimum quantity of stored yarn on the drum 2 and the acceleration of the electric motor 3 as controlled by control unit 11. Thus, the output signal of the digital yarn store sensor 20 will be generally at low logical potential, but sometimes changes to a high logical potential for a quite short period of time. Higher harmonic frequencies of this output signal are supressed in the low pass filter 21. The integrating circuit remains in its reset-condition when the output signal of sensor 20 is at low logical potential and carries out a short-time integration during the sensor signal high condition. Thus, the output signal of the integrating circuit 23 remains at low logical potential or continuously rises from zero volts to a relatively low voltage. The threshold comparator 24 compares this signal with a predetermined voltage threshold. This voltage threshold is adjusted such as to be higher than the highest output signal of the integrating circuit 23 under normal operating conditions of the loom. Thus, the output signal of threshold comparator 24 remains at zero potential if the comparator is supplied with the above mentioned output signal of the integrating circuit 23. Thus, the RS-flip-flop circuit 25 remains in its reset condition and therefore feeds a low logical potential signal to the relay 26. The relay 26 is of the normally closed type, which means that its power switch is in a normally closed condition. One terminal of the relay power switch is connected to the mains, whereas the other output terminal is connected to a loom power supply input terminal. Hence, the loom is supplied with an AC-current if no yarn breakage is detected by the digital yarn store sensor 20.

In case a yarn breakage occurs between the supply spool S and the feeding device 1, the quantity of yarn on the drum 2 will decrease and will cause the digital yarn store sensor 20 to produce a high logical potential signal. Thus, the input signal of the integrating circuit 23 changes to low logical potential as soon as a yarn breakage is detected. Therefore, a continuously increasing voltage signal appears at the output terminal of the integrating circuit 23. As soon as this voltage exceeds the threshold voltage of the threshold comparator 24, the comparator 24 generates a signal having a high logical potential. Thus, the RS-flip-flop circuit 24 is set. Hence, circuit 25 feeds a high logical potential signal to relay 26 so as to open the power switch of this relay. Thus, the loom becomes disconnected from the mains in case of a yarn breakage.

Figure 6:
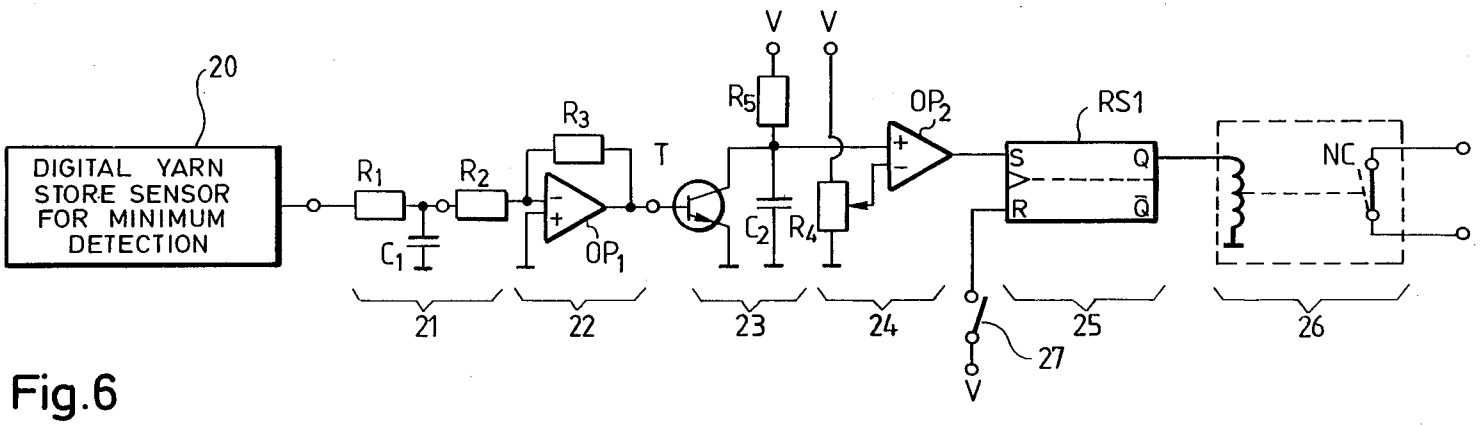
FIG. 6 is a circuit diagram of the first embodiment of FIG. 5.

Referring now to FIG. 6, there is shown a circuit diagram of the embodiment as shown in FIG. 5. The low pass filter 21 comprises a resistor $R_1$ and a capacitor $C_1$ which are serially connected, and which determine a suitable transmission characteristics. The junction node of these elements $R_1$, $C_1$ is connected to the input terminal of inverter 22, comprising an operational amplifier $OP_1$ having an input resistor $R_2$ connected to its negative terminal and a feedback-resistor $R_3$ in its feedback-path. The output of the inverter 22 is connected to the base of a transistor $T_1$ which is in parallel to a capacitor $C_2$ which in turn is serially connected to a DC-source having a predetermined voltage V by means of a further resistor $R_5$. The common node of the resistor $R_5$ and $C_2$ is connected to the input terminal of a threshold comparator 24. This comparator 24 consists of an operational amplifier $OP_2$ and a voltage dividing variable resistor $R_4$, which is connected with its end to the above-mentioned DC-source, with its other end to the ground and with its intermediate terminal to the negative terminal of the operational amplifier $OP_2$. The positive input terminal of this operational amplifier is the input terminal of said comparator circuit. An output of the threshold comparator 24 is connected to a set-terminal of a RS-flip-flop circuit 25, whereas the reset terminal of this circuit 25 is connectable to a high logical potential V by means of a manual reset switch 27. The output of this hold-circuit is connected to one input terminal of a power-relay 26, whereas its other input terminal is grounded. This relay 26 comprises a normally closed switch NC.

Figure 7:
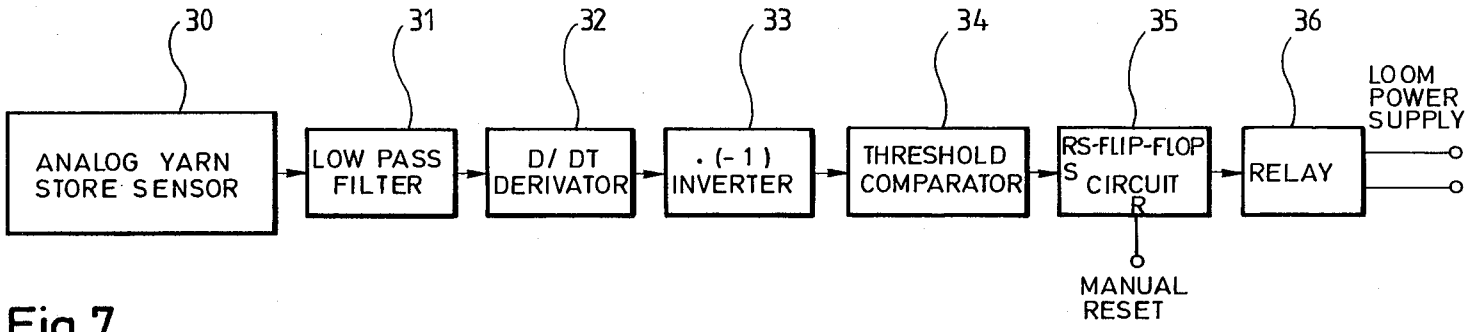
FIG. 7 is a system block diagram of a second embodiment of the present invention.

Referring now to FIG. 7, there is shown a second embodiment of the loom control system according to the present invention. This system comprises an analog yarn store sensor 30, a low pass filter 31, a differentiator or derivator 32, an inverter 33, a threshold comparator 34, a RS-flip-flop circuit 35 and a relay 36, these elements being serially connected in this order. This embodiment is suitable for a loom having a feeding device 1 which is controlled to essentially continuously feed the yarn to the storage drum 2. For understanding the mode of operation of this second embodiment, the time-dependency of the quantity of yarn stored on the storage drum 2 under normal conditions, i.e. if no yarn breakage occurs between the supply spool S and the feeding device 1, and under abnormal conditions, i.e. if a yarn breakage occurs, will be considered hereinafter. Under normal operating conditions, the quantity of yarn has a positive gradient during a first period of time, in which the feeding device 1 stores yarn on the storage drum 2 and the loom does not withdraw any yarn from this drum, and a predetermined negative gradient of the quantity with respect to the time during a second period of time, during which yarn is withdrawn from the drum and during which yarn is fed to the drum by the feeding device 1. This predetermined negative gradient is the difference between the quantity of yarn fed to the drum per time unit and the quantity of yarn withdrawn from the drum per time unit. If a yarn breakage occurs, the quantity of yarn fed to the drum per time unit becomes zero, so that the gradient becomes more negative than the predetermined one. Thus, information on yarn breakage can be derived from the gradient of the quantity of stored yarn with respect to time.

The analog yarn store sensor 30 is per se well known in the art, so that a detailed description of this analog yarn store sensor can be omitted. Exemplifications of such sensors are found in the Swedish Pat. No. 77 12 808 (applicant's own).

The output signal of this analog yarn store sensor is proportional to the quantity of yarn stored on the drum. This signal is smoothed by the low pass filter 31 and fed to the derivator 32. The output signal of this derivator 32 corresponds to the gradient or first derivation of the quantity of stored yarn with respect to the time. The sign of this gradient is changed by the inverter 33 from minus to plus or from plus to minus, respectively. Thus, the output signal of the inverter 33 is indirectly proportional to the gradient of the quantity of stored yarn with respect to the time. This inverted gradient signal is fed to the threshold comparator 34, which compares the absolute value of this negative gradient signal with a predetermined gradient threshold. If the absolute value exceeds said gradient threshold, the RS-flip-flop circuit 35 is set by its input signal. The output signal of this circuit 35 is fed to a relay 36 which corresponds to the relay 26 in the first embodiment shown in FIGS. 5 and 6. Thus, the loom is stopped if the gradient of the quantity of stored yarn with respect to the time becomes more negative than a predetermined negative value, which indicates a yarn breakage between the supply spool S and the feeding device 1.

Figure 8:
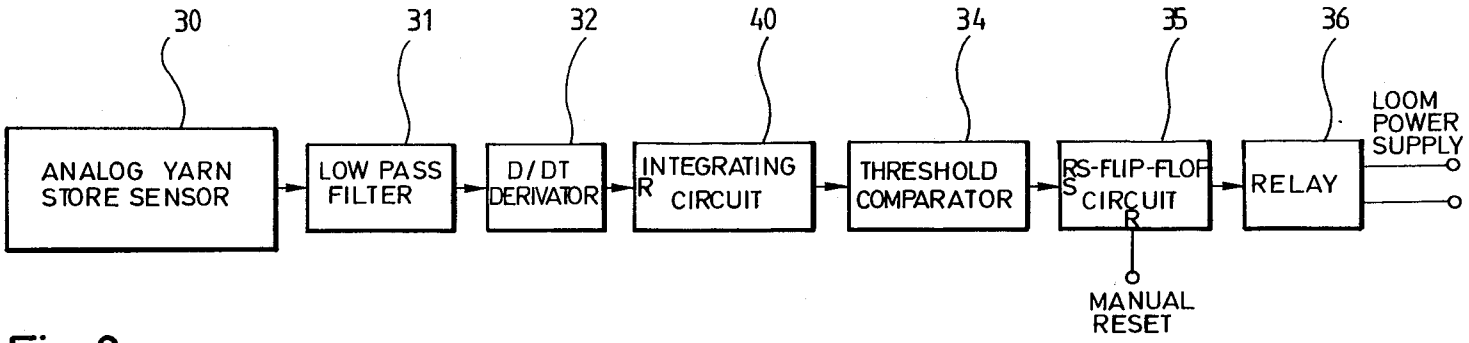
FIG. 8 is a system block diagram of a third embodiment of the present invention.

FIG. 8 shows a third embodiment of the present invention. Identical or similar circuit elements are designated with the same reference numerals as used in the foregoing Figures. As mentioned above, the quantity of stored yarn with respect to time has a positive gradient during a first period of time and a negative gradient during a second period of time, again a positive gradient during a third period of time corresponding to the first period of time and so on. However, if a yarn breakage occurs between the spool and the feeding device, said gradient never becomes positive. Consequently, a gradient which never becomes positive indicates a yarn breakage.

This third embodiment comprises an analog yarn store sensor 30, a low pass filter 31, a derivator 32, an integrating circuit 40, a threshold comparator 34, a RS-flip-flop circuit 35 and a relay 36, wherein these circuit elements are serially connected in this order. The output signal of the analog yarn store sensor 30 is fed to the low pass filter 31 smoothing said signal and further fed to the derivator 32, the output signal of which corresponds to the first derivation or gradient of the quantity of stored yarn with respect to time. A positive gradient signal resets the integrating circuit 40. Thus, under normal operating conditions, the integrating circuit 40 is periodically reset by the positive gradient signal. In case of a yarn breakage, the integrating circuit 40 receives no reset-signal. This circuit may be realized similar to the integrating circuit 23 as shown in FIG. 6, but has a slower integrating operation when compared with the operation of circuit 23. The output signal of the integrating circuit 40 is similar to a saw-tooth-wave form in case of normal operation conditions, and always has an increasing voltage in case of a yarn breakage. The threshold comparator 34 compares this signal with a predetermined threshold voltage being such that the output signal of the integrating circuit 40 never exceeds the threshold voltage if no yarn breakage occurs. Otherwise, the output voltage of the integrating circuit 40 continuously increases (until reaching an upper limit voltage similar to the supply voltage of the integrating circuit 40) and thereby causes the threshold comparator 34 to generate a high potential output signal. This signal is fed to the set terminal of the RS-flip-flop circuit 35 which is set in case of a yarn breakage. Hence, a high logical potential signal is fed to the relay 36 in case of a yarn breakage, so that the loom operation is stopped.

Figure 9:
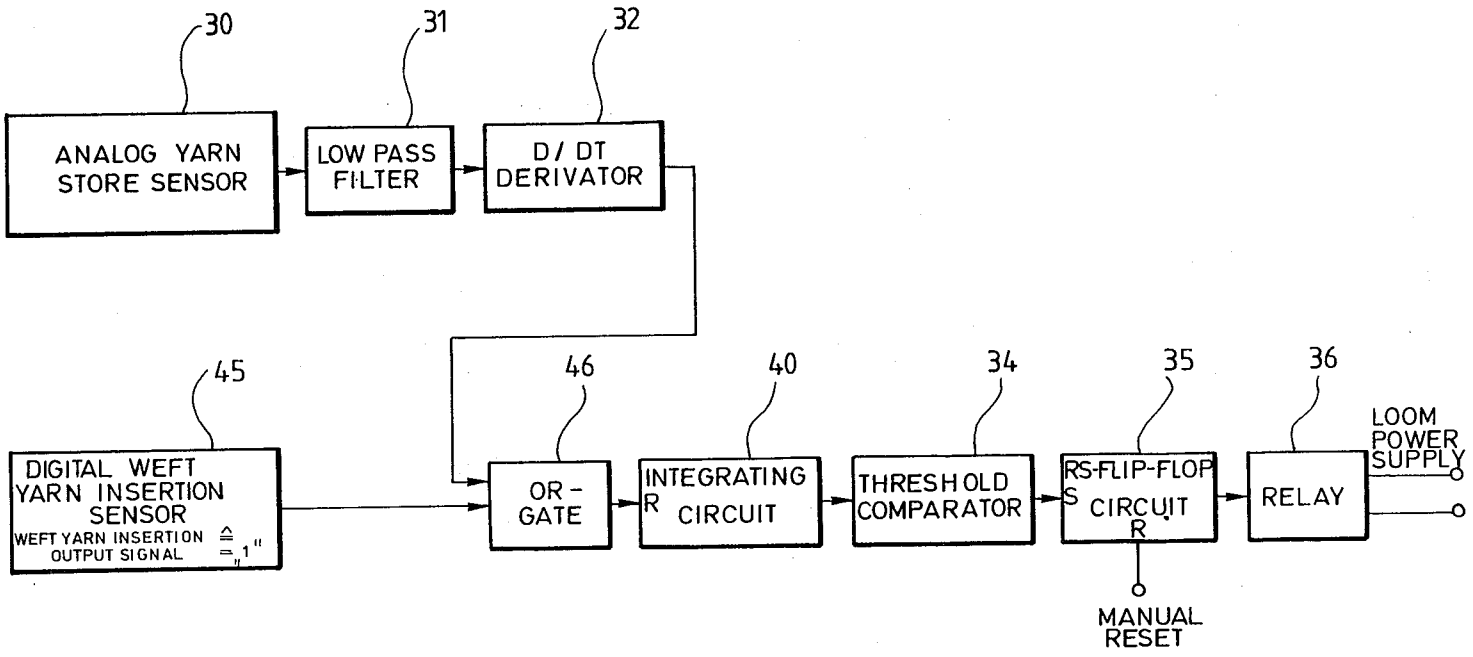
FIG. 9 is a system diagram of a fourth embodiment of the present invention.

An alternative fourth embodiment of the loom control system in accordance with the present invention for stopping the loom in case of a yarn breakage between the supply spool S and the feeding device 1 is shown in FIG. 9. This embodiment comprises an analog yarn store sensor 30 connected to a low pass filter 31 for smoothing the sensor output signal. The output signal of the low pass filter is fed to a derivator 32. The output signal of the derivator 32 is fed to a first input terminal of an OR-gate 46. The other input terminal of this gate 46 is connected to an output terminal of a digital weft yarn insertion sensor. This weft yarn insertion sensor generates a yarn insertion signal having a high logical potential when weft insertion takes place and having a low logical potential when no weft yarn insertion takes place. This sensor can be realized as a switch connected to a DC-source and operated, i.e. opened or closed by the respective position of a weft yarn insertion means (not shown here). The output signal of gate 46 is fed to a reset terminal of an integrating circuit 40, which in turn is connected to a threshold comparator 34 comparing the output signal of the integrating circuit 40 with a predetermined voltage threshold. If this output signal exceeds said voltage threshold, the comparator generates a high logical potential output signal. Otherwise, the output signal of the threshold comparator 34 remains at low potential. This signal is fed to hold-circuit or RS-flip-flop circuit 35 which turns on or off a relay 36 wherein these elements 35,36 correspond to elements 35, 36 as described with reference to the foregoing Figures.

Under normal operating conditions, the gradient of the quantity of stored yarn with respect to time changes from a negative gradient to a positive gradient if the weft yarn insertion has come to an end, so that the withdrawal of yarn from the drum 2 has come to an end. However, it should be noted that there is a time delay between the end of weft yarn insertion and the end of withdrawal of yarn from the drum, this time delay being caused by certain machine characteristics and yarn characteristics such as elasticity. Thus, the end of withdrawal of yarn from the drum is a little later than the end of weft yarn insertion. Thus, under normal operating conditions, if no yarn breakage occurs between the supply spool and the feeding device, the gradient changes from negative to positive at a moment which is a little later than the moment at which the weft yarn insertion signal changes from high logical potential to zero logical potential. If a yarn breakage occurs, the gradient does not change from negative to positive within a period of time corresponding to the above mentioned delay-time after the weft yarn insertion signal changed from high to low. Thus, the period of time between said change of the weft yarn insertion signal and said change of gradient can be used for deriving information on yarn breakage.

The integrating circuit 40 remains in its reset condition as long as the sensor 45 generates a weft yarn insertion signal. If this signal changes to low potential, indicating that the weft yarn insertion has come to an end, the integrating circuit 40 starts with its integrating operation. Thus, a slowly increasing voltage is generated by the integrating circuit 40. If no yarn breakage occurs, the integrating circuit becomes reset as soon as the derivator 32 generates a positive gradient signal. Within this time, the output voltage of the integrating circuit 40 does not exceed the voltage threshold of the comparator 34. If, on the contrary, a yarn breakage occurs, no positive gradient signal will be generated by the derivator 32. Thus, the integrating circuit generates a continuously increasing output voltage (until this voltage equals the supply voltage of the integrating circuit 40). In this case, the threshold comparator 34 generates a high logical potential output signal setting the circuit 35 and opening the relay 36. Thus, the loom is stopped in case of a yarn breakage.

Figure 10:
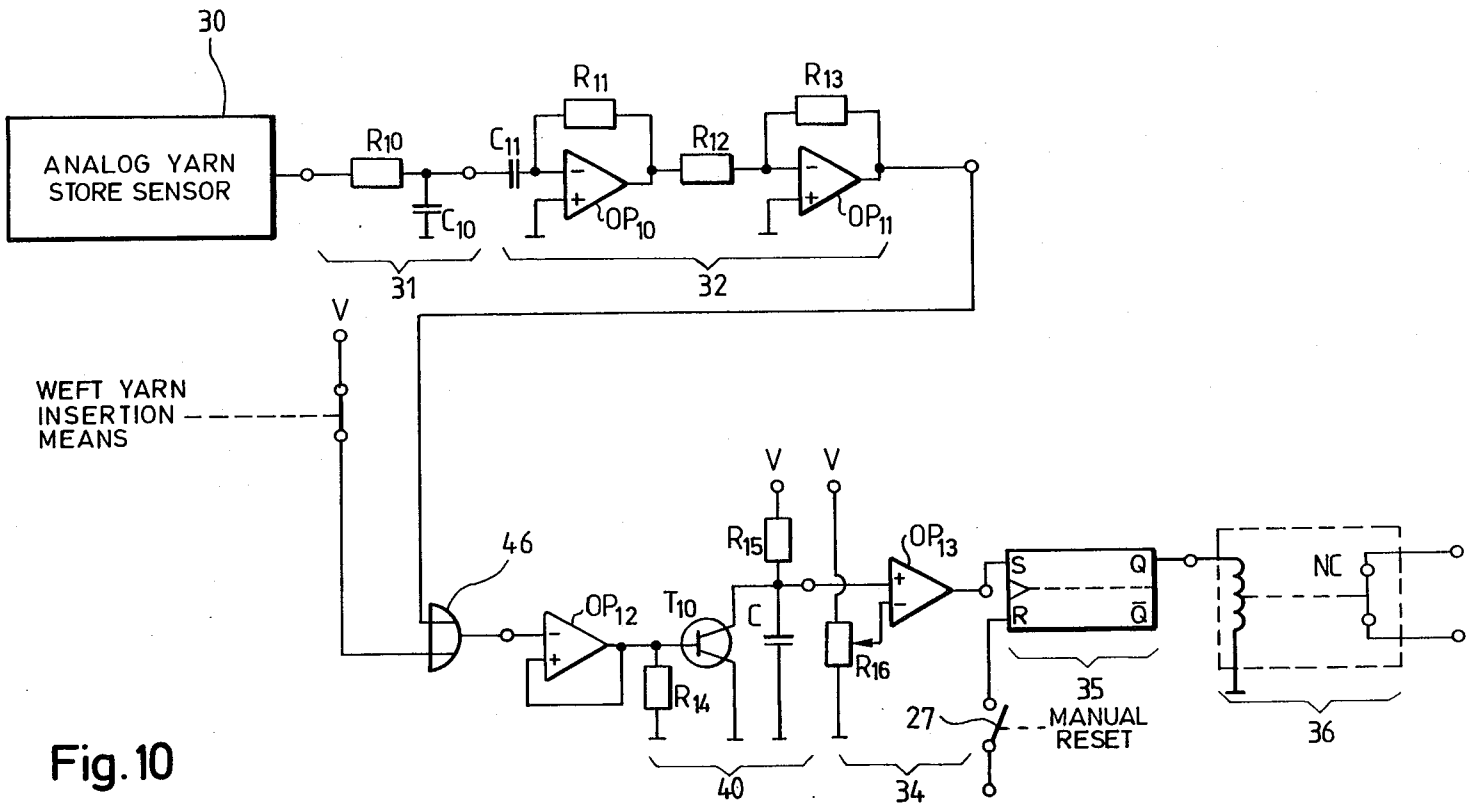
FIG. 10 is a circuit diagram of the fourth embodiment as shown in FIG. 9.

FIG. 10 shows a circuit diagram of the fourth embodiment of the inventive loom control system. The low pass filter 31 consists of a resistor $R_{10}$ and a capacitor $C_{10}$ in serial connection. The common node of these elements $R_{10}$, $C_{10}$ is connected to the input terminal of the derivator 32. This derivator comprises a capacitor $C_{11}$ connected to its input terminal and the negative input terminal of an operational amplifier $OP_{10}$. The positive terminal of this amplifier is grounded. A resistor $R_{11}$ is connected to the negative input terminal and to the output terminal of this amplifier and serves as a feedback-path. The output signal of this circuitry $OP_{10}$, $C_{11}$, $R_{11}$ is the negative first derivation of its input signal. The derivator 32 also comprises inverter circuitry $R_{12}$, $R_{13}$, $OP_{11}$ similar to the inverter 22 of FIGS. 5 and 6. This inverter circuit changes the sign of the output signal of amplifier $OP_{10}$. Thus, the output signal of the derivator 32 corresponds to the gradient of the sensor signal. Said gradient signal is fed to a first input terminal of the OR-gate 46, wherein the second input terminal of this gate is connectable to a DC-source by means of a switch which serves as digital weft yarn insertion sensor 45. This switch is operated by the weft yarn insertion means.

The output signal of the OR-gate is fed to the positive input terminal of an operation amplifier $OP_{12}$, which serves as an impedance transformer. The output signal of this amplifier $OP_{12}$ is a reset signal for the integrating circuit 40. The integrating circuit 40, the threshold comparator 35, the RS-flip-flop circuit 35 and the relay 36 are quite similar to the circuit elements 23 to 26 of FIG. 6, so that it is believed that a detailed explanation of these elements can be omitted.

The embodiments of FIGS. 5 to 10 are capable of detecting a yarn breakage between the supply spool S and the feeding device 1. However, a yarn breakage might even occur between the feeding device 1 and the loom. The fifth embodiment (FIG. 11) of the loom control system in accordance with the present invention is capable of detecting this kind of yarn breakage. This embodiment comprises an analog yarn sensor 30, a low pass filter 31, a derivator 32, a digital weft yarn insertion sensor 45, an AND-gate 46, a RS-flip-flop circuit 35 and a relay 36.

Figure 11:
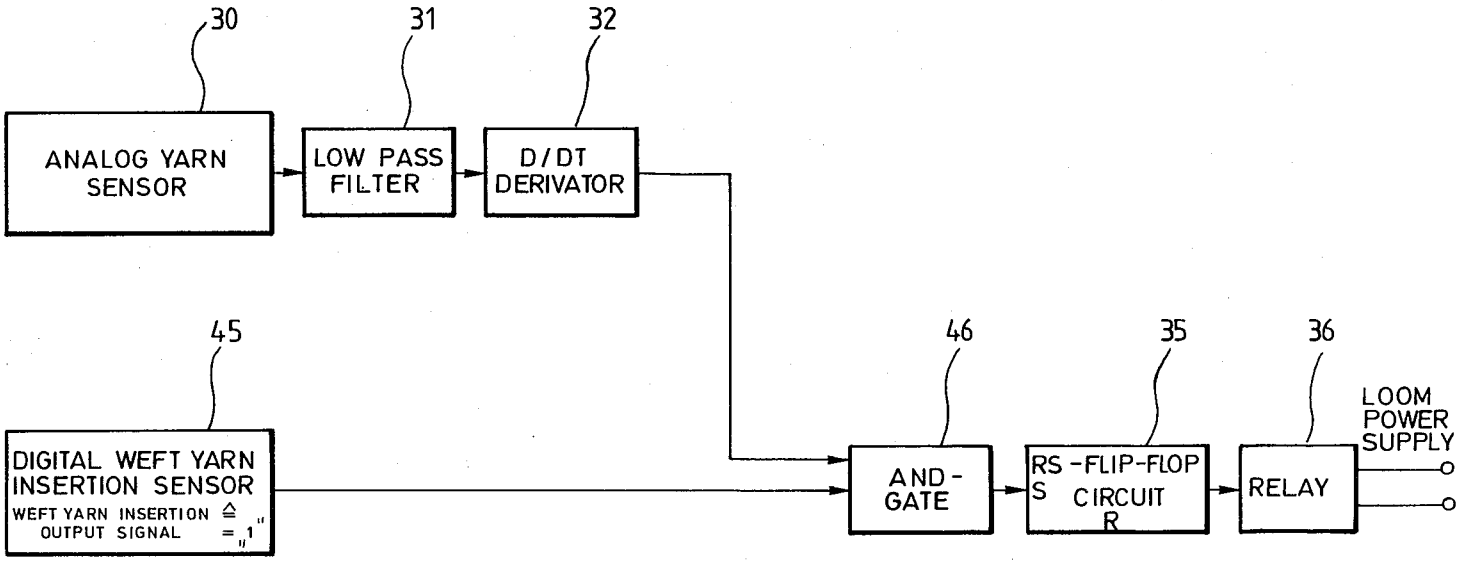
FIG. 11 is a fifth embodiment of the present invention.

If no yarn breakage occurs, the quantity of yarn stored on the drum decreases during weft yarn insertion. Only if the yarn breaks between the feeding device 1 and the loom, the quantity of yarn increases although a weft yarn insertion signal is generated by the sensor 45. Therefore, the simultaneous occurence of a positive gradient of the quantity of yarn with respect to time and a weft yarn insertion signal representing that weft yarn insertion has taken place indicates that this kind of yarn breakage has occured. The embodiment of FIG. 11 includes an AND-gate 46 for determining whether the above mentioned condition is fulfilled. If so, the AND-gate 46 generates a high signal for setting the circuit 35, which in turn opens the normally closed power switch of relay 36. Thus, the loom is stopped by the loom control system as shown in FIG. 11 in case of a yarn breakage between the drum and the loom.

It is evident for a man skilled in the art that the circuitries as shown in FIGS. 5 to 11 can easily be combined with each other so as to provide a loom control system capable of detecting more than only one possible error-condition. For example, it is possible to use a common RS-flip-flop circuit 25, 35 and a common relay 26, 36 for a loom control system comprising more than one of said embodiments. In this case, the output signals of the respective circuit elements, which are shown as being connected to the respective RS-flip-flop circuits 25, 35 are used as input signals to an OR-gate connected to the set-terminal of the common RS-flip-flop circuit.

It is also easily possible for a man skilled in the art to replace the embodiments shown in FIGS. 5 to 11 by a suitably programmed micro-processor.

Furthermore, the above described opto-electric sensors can be replaced by mechanical sensors.

The control system in accordance with the present invention can also be applied to each kind of thread processing machines comprising a feeding device for generating a substantially constant tension of the yarn to be fed to the processing machine. Thread processing machines comprising feeding devices can be, for example, winding machines for re-spooling the yarn from one spool to another, twisting machines, spinning machines and knitting machines. Furthermore, the control system in accordance with the present invention can also be applied to winding machines for winding an electrical conductor on the core of a rotor of an electrical motor, and for winding an electrical conductor on a core of an electrical coil.

The embodiments of the invention in which an exclusive property or privilege is claimed are defined as follows:

1. A loom control system operable to stop a loom in the presence of a yarn breakage, said loom including a feeding device having a yarn storage drum for temporarily storing the yarn, and yarn store sensor means for sensing the quantity of yarn stored on said drum of said feeding device and for transmitting an electric sensor signal representing the quantity of yarn stored on said drum to said feeding device to control the operation of said feeding device and to thereby control the quantity of yarn stored on said drum, said loom control system including monitor means for detecting a yarn breakage and for stopping the loom in the event of a yarn breakage, wherein the improvement comprises said monitor means being electrically connected to said yarn store sensor means for receiving said sensor signal therefrom, and said monitor means being responsive to said sensor signal representing the quantity of yarn stored on said drum for detecting a yarn breakage and said monitor means generating a stop signal for the loom in response to detection of a yarn breakage.

2. Loom control system as claimed in claim 1, wherein said sensor signal generated by said yarn store sensor means indicates whether the quantity of stored yarn is below a minimum threshold, wherein said monitor means is responsive to the period of time during which said sensor signal indicates that the quantity of stored yarn is continuously below said minimum threshold, and wherein said monitor means stops the loom if said period of time exceeds a predetermined time threshold.

3. Loom control system as claimed in claim 1, wherein said feeding device is controlled so as to essentially continuously feed the yarn to said drum, wherein said yarn store sensor means includes an analog sensor, wherein said sensor signal is proportional to the quantity of yarn stored on said drum, wherein said monitor means generates a gradient signal representing the first derivative of said sensor signal with respect to time, wherein when said gradient signal is negative, which indicates a decreasing quantity of yarn stored on said drum, said monitor means compares the absolute value of the negative gradient signal with a predetermined gradient threshold, and wherein said monitor means stops the loom if said absolute value exceeds said gradient threshold.

4. Loom control system as claimed in claim 1, wherein said yarn store sensor means includes an analog sensor, wherein said sensor signal is proportional to the quantity of yarn stored on said drum, wherein said monitor means generates a gradient signal representing the first derivative of said sensor signal with respect to time, wherein said monitor means measures the period of time during which said gradient is continuously negative, and wherein said monitor means stops the loom if said period of time exceeds a predetermined time threshold.

5. Loom control system as claimed in claim 1, wherein said feeding device is controlled so as to essentially continuously feed the yarn to said drum, wherein said yarn store sensor means includes an analog sensor, wherein said sensor signal is proportional to the quantity of yarn stored on said drum, wherein said monitor means generates a gradient signal representing the first derivative of said sensor signal with respect to time, wherein said loom control system includes insertion sensor means for generating a yarn insertion signal when a weft yarn insertion takes place, wherein when said gradient signal is a negative gradient signal said monitor means is responsive to the period of time during which said insertion signal indicates that no weft yarn insertion takes place, and wherein said monitor means stops the loom if, while said gradient signal is negative, said period of time exceeds a predetermined time threshold.

6. Loom control system as claimed in claim 1, wherein said feeding device is controlled so as to essentially continuously feed the yarn to said drum, wherein said yarn store sensor means includes an analog sensor, wherein said sensor signal is proportional to the quantity of yarn stored on said drum, wherein said monitor means generates a gradient signal representing the first derivative of said sensor signal with respect to time, wherein said loom control system includes insertion sensor means for generating a yarn insertion signal when a weft yarn insertion takes place, and wherein said monitor means stops the loom if the following two conditions are simultaneously fulfilled:

(a) said gradient signal is positive, and (b) said insertion signal is indicating the occurrence of a weft yarn insertion.

* * * * *